US006622441B2

(12) United States Patent
Miller

(10) Patent No.: US 6,622,441 B2
(45) Date of Patent: Sep. 23, 2003

(54) WINDOW FRAME SYSTEM

(76) Inventor: Allan S. Miller, 33-48 76th St., Jackson Heights, NY (US) 11372

( * ) Notice: Subject to any disclaimer, the term of this patent is extended or adjusted under 35 U.S.C. 154(b) by 0 days.

(21) Appl. No.: 10/142,723

(22) Filed: May 9, 2002

(65) Prior Publication Data

US 2003/0005651 A1 Jan. 9, 2003

Related U.S. Application Data

(63) Continuation of application No. 09/358,791, filed on Jul. 22, 1999, now Pat. No. 6,412,239.

(51) Int. Cl.[7] ..... E06B 1/04

(52) U.S. Cl. ..... 52/204.1; 52/235; 52/656.5; 52/656.6

(58) Field of Search ..... 49/501, 504; 52/656.5, 52/656.6, 656.2, 734.2, 456, 206, 461, 467, 468, 235, 780, 781, 204.1, DIG. 17

(56) References Cited

U.S. PATENT DOCUMENTS 812,467 A 2/1906 Watkins
1,171,443 A 2/1916 Larson et al.
2,872,713 A 2/1959 Hass
3,226,897 A 1/1966 Dorman
3,475,870 A 11/1969 Birum
4,621,478 A 11/1986 Phillips et al.
4,821,476 A 4/1989 Thoburn et al.
6,412,239 B1 * 7/2002 Miller ..... 52/204.1

* cited by examiner

*Primary Examiner*—Jerry Redman
(74) *Attorney, Agent, or Firm*—Brandon N. Sklar; Kaye Scholer, LLP

(57) ABSTRACT

The present invention is a window frame wherein all of the structural members are formed with the same substantially identically-shaped configuration a metal extrusion. A plurality of structural members are arranged to form a supporting structure. Each structural member has a U-shaped channel defined by a base portion having a first arm and a second arm spaced apart on opposite lengthwise sides of said base portion. The first and second arms extending from said base portion have end portions turned inward and extending in a direction toward said base portion. Fasteners detachably secure the plurality of structural members into a configuration adapted to detachably mount a translucent barrier within the supporting structure formed by the structural members.

13 Claims, 5 Drawing Sheets

WINDOW FRAME SYSTEM

This application is a continuation of U.S. application Ser. No. 09/358,791 entitled "WINDOW FRAME SYSTEM" and filed on Jul. 22, 1999, now U.S. Pat. No. 6,412,239.

FIELD OF THE INVENTION

The invention relates generally to improvements in the field of window framing systems for buildings of all types, and more particularly to such frames as are easily formed and readily adaptable to substantially any size or shape opening.

BACKGROUND OF THE INVENTION

As is well realized, there is currently a need for reducing manufacturing costs and simplifying the on-site construction of window framing systems. Metal window frames are increasingly used due to their strength, durability and ease of assembly. Such frames are commonly formed from different types or kinds of extrusions, which are manufactured by forcing molten metal through a die. By using differently shaped dies, nearly any shape of extrusion imaginable can be created.

Window frames have, in accordance with prior designs, required various different extrusions having differently-shaped configurations. That is, with respect to a particular window frame, not all of the peripheral frame members have been of the same configuration. Also, for many designs, window frame members must be cut at their ends to a 45 degree angle and then must be assembled at their corners to produce a window frame of a given size. All of this has contributed to the costliness of providing window frames for buildings of virtually any and all types.

In view of the foregoing, it is an object of the present invention to provide a window frame wherein all of the frame members are made of the same material, and have identically-shaped extruded configurations.

Another object of the present invention is to simplify the manner in which the structural frame members are joined or connected together and to increase the efficiency both in production and in assembly.

Various other objectives and advantages of the present invention will become apparent to those skilled in the art as a more detailed description is set forth below.

SUMMARY OF THE PRESENT INVENTION

In accordance with the present invention, a window frame is provided by arranging a plurality of support members to form a supporting structure. Each support member includes a plurality of identically-shaped structural members. Each of the structural members have a U-shaped channel defined by a base portion and two arms spaced apart on opposite lengthwise sides of the base portion. The arms extend from the base and have end portions turned inward that extend in a direction toward the base portion. The arms are substantially perpendicular to the base portion and can be of the same longitudinal length as the base portion. The end portions of both arms are substantially parallel to one another. The end portions of both arms are also in substantially parallel relationship to the base portion. A plurality of fasteners detachably secure the structural members in a configuration that is adapted to detachably mount a translucent barrier, such as a window made of glass. The fasteners can be adapted to nest in the end portions of both arms and to slidingly engage therewith.

The structural members of the window frame can be formed of metal and can be identically-shaped metal extrusions. Also, a gasket can be disposed between the structural members and the translucent barrier to prevent heat loss and access to weather elements.

DETAILED DESCRIPTION OF THE INVENTION

The window frame according to the present invention comprises support members shown in FIGS. 1–5. As will be readily apparent to those persons skilled in the art, the subject invention is not limited to any particular type or style of window frame. The support members may or may not be arranged in a closed pattern and may be arranged in different shapes such as a rectangle, square, triangle, etc., as appropriate or aesthetically desired.

Figure 1:
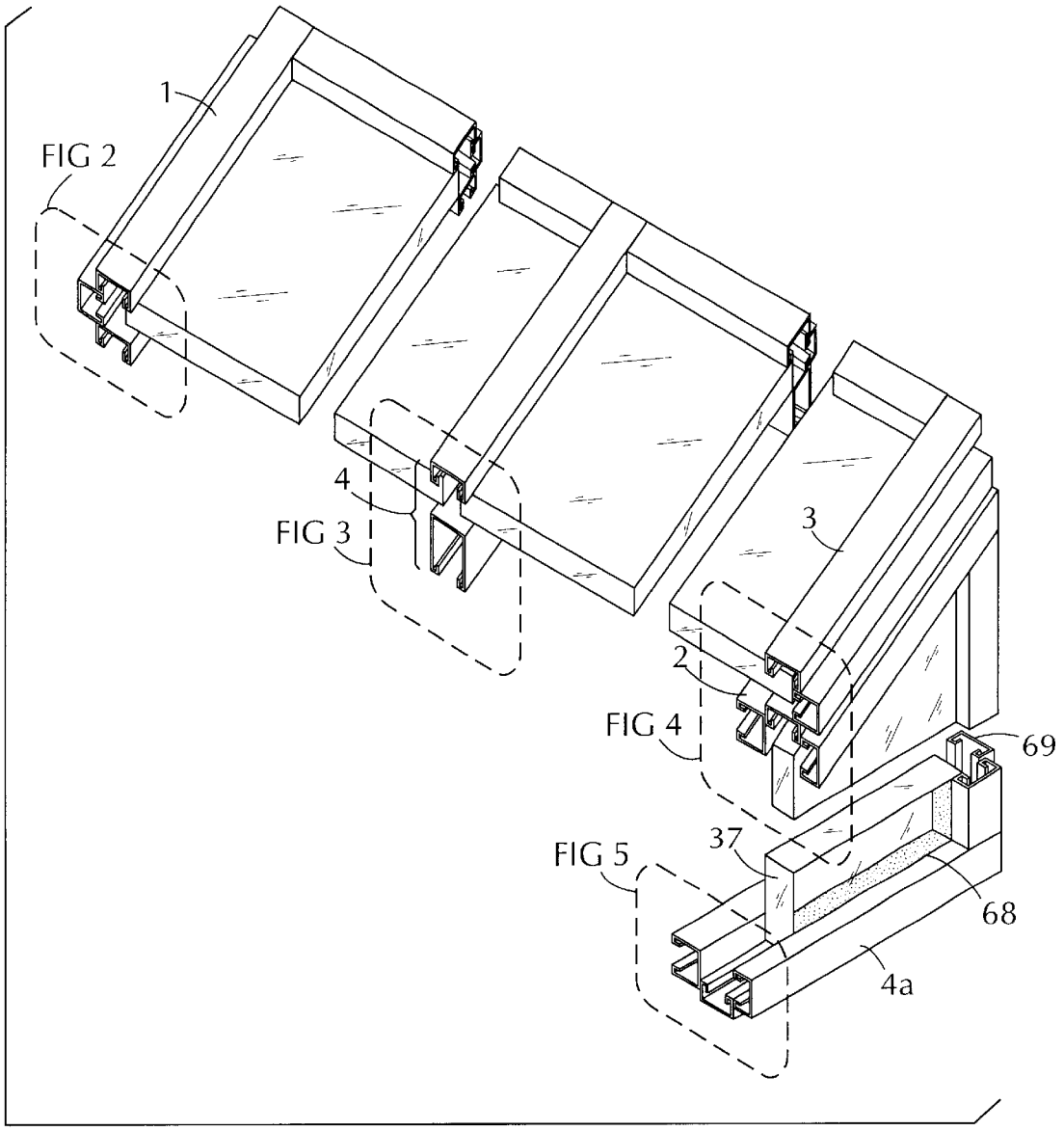
FIG. 1 is a perspective view of support members arranged to form the window frame of the present invention.

FIG. 1 shows a typical window frame of the invention having a plurality of support members arranged to form a supporting structure. Each support member (1), (2), (3), (4), and **(4(*a*))** includes a plurality of structural members joined together to form the sides of the support member. In accordance with the present invention, the structural members are identical to each other. The use of identically-shaped frame members reduces the manufacturing costs and simplifies the on-site construction of the window frame. While the support members are generally metal extrusions (e.g., aluminum or an alloy of aluminum) any other appropriate material which is capable of being formed with the desired identically-shaped configuration may be used.

Each of the structural members of the present invention have identically-shaped configurations. For example, support member (1) depicted in FIG. 2 includes a first structural member (5), a second structural member (6) and a third structural member (7). Each structural member has a U-shaped channel defined therein. Structural member (5) illustrates a U-shaped channel defined by a base portion (8), a first arm (9) and a second arm (10). In accordance with the invention, the first arm (9) and second arm (10) of structural member (5) have end portions (11) and (12) that are turned inward. The end portions extend in a direction toward the base portion (8). Fastener (13) is adapted to nest on the inside surface of the end portions (11) and (12) and to slidingly engage therewith.

Figure 2:
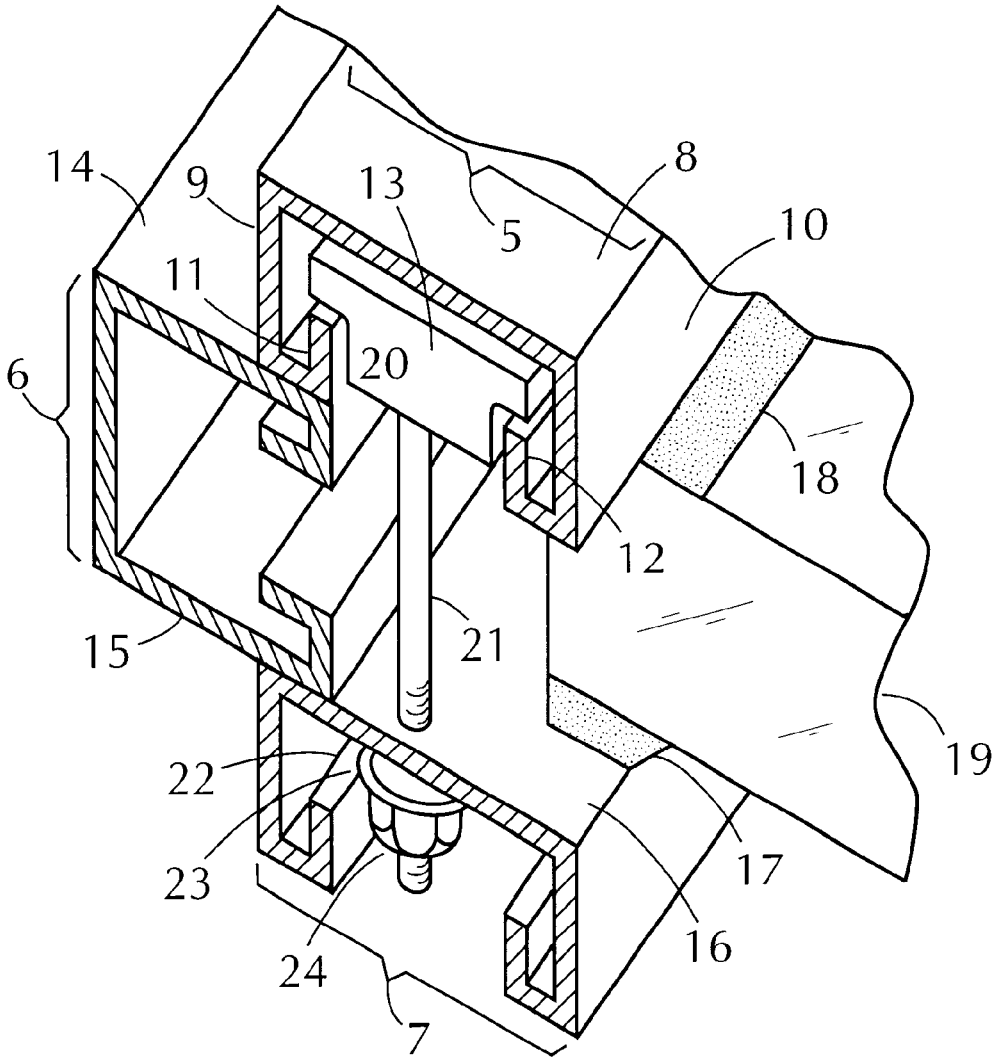
FIG. 2 is a front cutaway view of structural members arranged to form a support member of the present invention.

FIG. 2 is a close-up cutaway view of support member (1) that is depicted in the window frame of FIG. 1. FIG. 2 illustrates the configuration of structural members (5), (6) and (7) wherein the three structural members are in overlying relation to one another and are configured to form a support member (1). In accordance with this invention, the outside surface of arm (14) of structural member (6) is in overlying relation with at least a portion of the outside surface of the end portion (11) of structural member (5). The outside surface of arm (15) of structural member (6) is in further overlying relation with at least a portion of the outside surface of the base portion (16) of structural member (7).

FIG. 2 also illustrates that gaskets (17) and (18) are disposed between the two structural members (5) and (7) and translucent barrier (19). The gaskets (17) and (18) are made of any suitable materials as are known to those skilled in the art such as elastomeric materials. The gaskets (17) and (18) serve the purpose of preventing heat loss and access to weather elements.

As seen in FIG. 2, support member (1) is firmly held together by fastener (13). Fastener (13) is a combination of a channel nut (20), a threaded rod (21), a flat washer (22), a lock washer (23), and a nut (27). Threaded rod (21) is seen positioned in a hole drilled through the outside surface of base portion (16) of structural member (7) and into the defined U-shaped channel of structural member (7). The defined U-shaped channel serves as an area to place nut (24) on the threaded rod (21). The hole in which threaded rod (21) is positioned is located outwardly beyond the region in which translucent barrier (19) is disposed. Securing nut (24) to the distal end of the threaded rod (21) detachably secures structural member (5) to structural (7) with structural member (6) and translucent barrier (19) detachably secured therebetween.

Significantly, the translucent barrier and the structural members may be detachably secured in place by any well known fastening devices readily apparent to those persons skilled in the art. The invention herein defined is not limited to any particular type or style of fastener.

Figure 3:
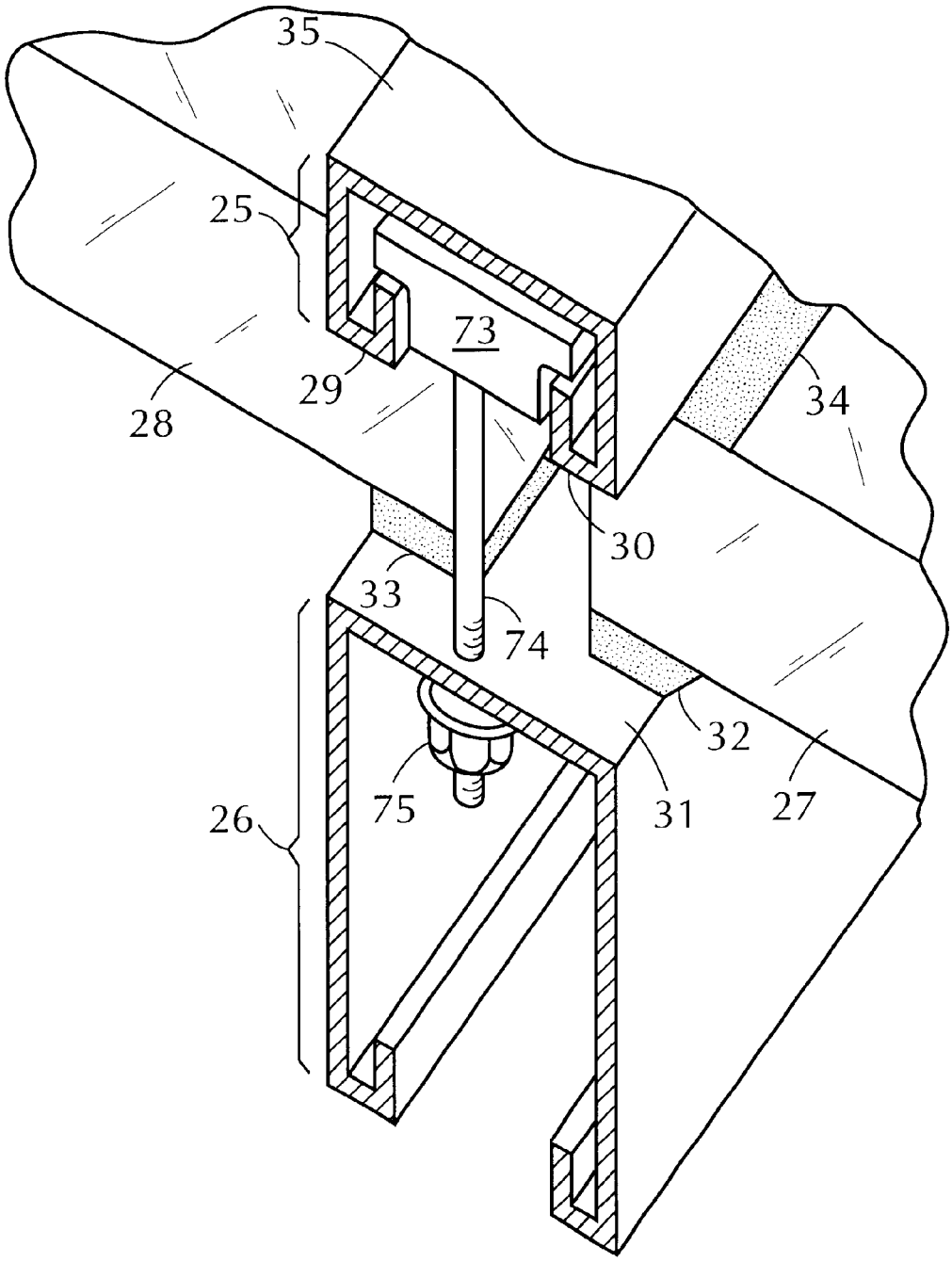
FIG. 3 is a front cutaway view of structural members arranged to form a support member that permits installation of adjacent windows or panel assemblies.

Referring to FIG. 3, it is seen how the window frame of FIG. 1 permits installation of adjacent windows or paneling assemblies. As shown in FIG. 3, a support member (4) includes a first structural member (25) and a second structural member (26). Here, first structural member (25) and second structural member (26) are not in overlying relationship to one another. Rather, first structural member (25) and second structural member (26) are each on opposite sides of the two adjacent translucent barriers (27) and (28). Each structural member (25) and (26) overlie the junction between the two translucent barriers (27) and (28) to define support member (4).

In this configuration, the outside surface of end portion (29) of structural member (25) is in overlying relation with at least a portion of translucent barrier (28). The outside surface of end portion (30) of structural member (25) is also in overlying relation to at least a portion of translucent barrier (27). The base portion (31) of structural member (26) is in overlying relation with at least a portion of translucent barrier (27) and is also in overlying relation with at least a portion of translucent barrier (28). Gaskets (32) and (33) are disposed between structural member (26) and translucent barriers (27) and (28). Also, gaskets (34) and (35) are disposed between structural member (25) and translucent barriers (27) and (28).

Similar to FIG. 2, support member (4) of FIG. 3 is firmly held together by fastener (73). Threaded rod (74) of fastener (73) is seen positioned in a hole drilled through the outside surface of base portion (31) of structural member (26) and into the defined U-shaped channel of structural member (26). The hole in which threaded rod (74) is positioned is located outwardly beyond the region in which adjacent translucent barriers (27) and (28) are disposed. Securing nut (75) to the distal end of threaded rod (74) detachably secures structural member (25) to structural member (26) with translucent barriers (27) and (28) detachably secured therebetween.

Figure 4:
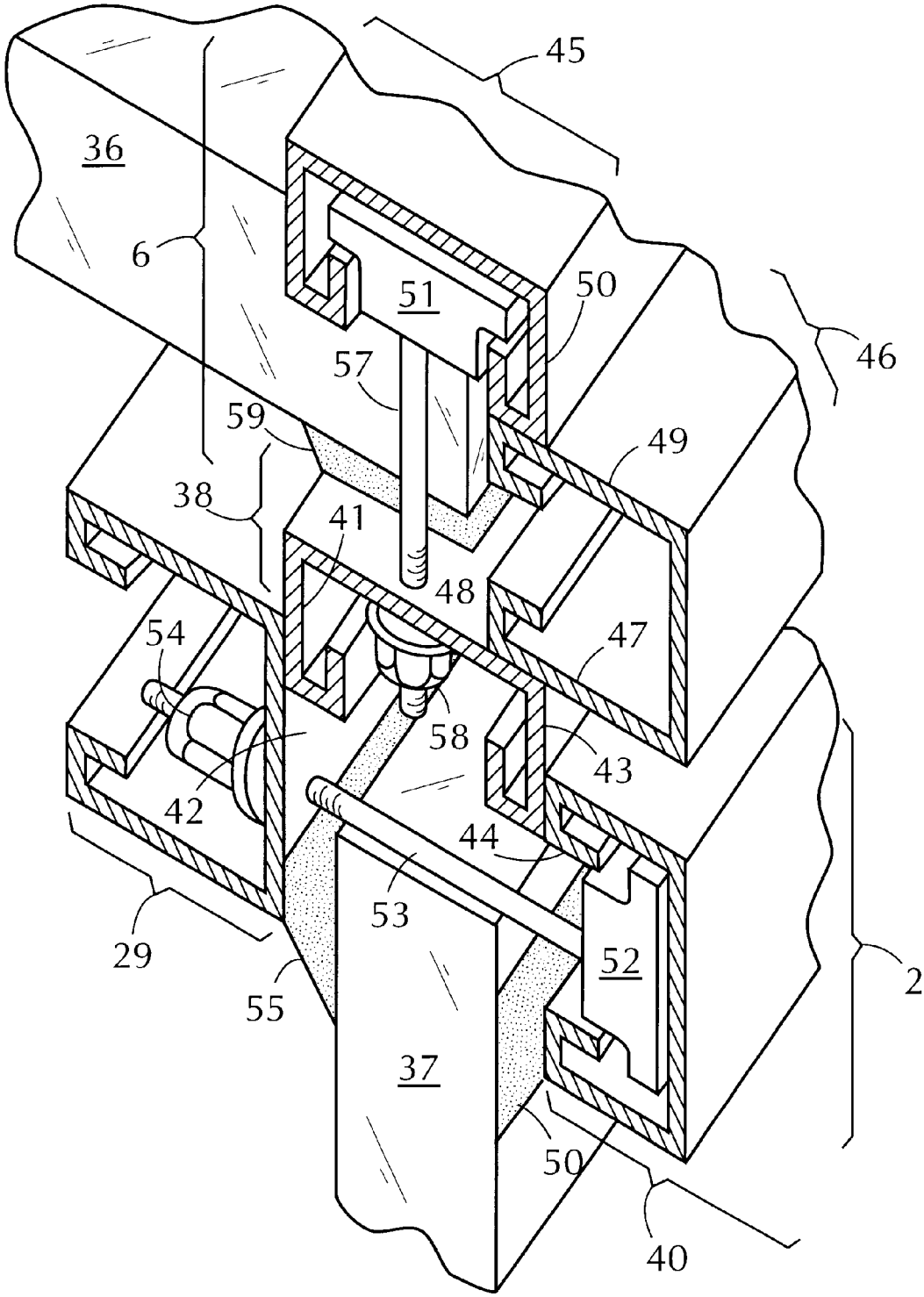
FIG. 4 is a front cutaway view of structural members arranged to form two support members to detachably mount translucent barriers in perpendicular relationship to one another.

FIG. 4 illustrates a close-up cutaway view of support members (2) and (3) configured to detachably mount two translucent barriers (36) and (37) in perpendicular relationship to one another. The configuration of FIG. 4 illustrates that structural member (38) is included as one of three structural members forming support member (2) and that structural member (38) is also included as one of the three structural members forming support member (3).

In accordance with the invention, FIG. 4 illustrates that structural members (38), (39) and (40) are in overlying relation to one another and are configured to form support member (2). The outside surface of arm (41) of structural member (38) is in overlying relation with at least a portion of the outside surface of base portion (42) of structural member (39). The outside surface of arm (43) of structural member (38) is in further overlying relation with at least a portion of the outside surface of end portion (44) of structural member (40).

As set forth in FIG. 4, structural members (38), (45) and (46) are also in overlying relation to one another and are configured to form support member (30). The outside surface of arm (47) of structural member (46) is in overlying relation with at least a portion of the outside surface of base portion (48) of structural member (38). The outside surface of arm (49) is in further overlying relationship with at least a portion of the outside surface of end portion (50) of structural member (45).

Similar to FIG. 2, support members (2) and (3) of FIG. 4 are firmly held together by fasteners (51) and (52). Threaded rod (53) of fastener (52) is seen positioned in a hole drilled through the outside surface of base portion (42) of structural member (39) and into the defined U-shaped channel of structural member (39). The hole in which threaded rod (53) is positioned is located outwardly beyond the region in which translucent barrier (37) is disposed. Securing nut (54) to the distal end of threaded rod (53) detachably secures structural member (39) to structural member (40) with structural member (38) and translucent barrier (37) detachably secured therebetween. Gaskets (59) and (60) are disposed between the two structural members (38) and (45) and translucent barrier (36).

Threaded rod (57) of fastener (52) is seen positioned in a hole drilled through the outside surface of base portion (48) of structural member (38). The hole in which threaded rod (57) is positioned is located outwardly beyond the region in which translucent barrier (36) is disposed. Securing nut (58) to the distal end of threaded rod (57) detachably secures structural member (38) to structural member (45) with structural member (46) and translucent barrier (36) detachably secured therebetween. Gaskets (59) and (60) are disposed between the two structural members (38) and (45) and translucent barrier (36).

Figure 5:
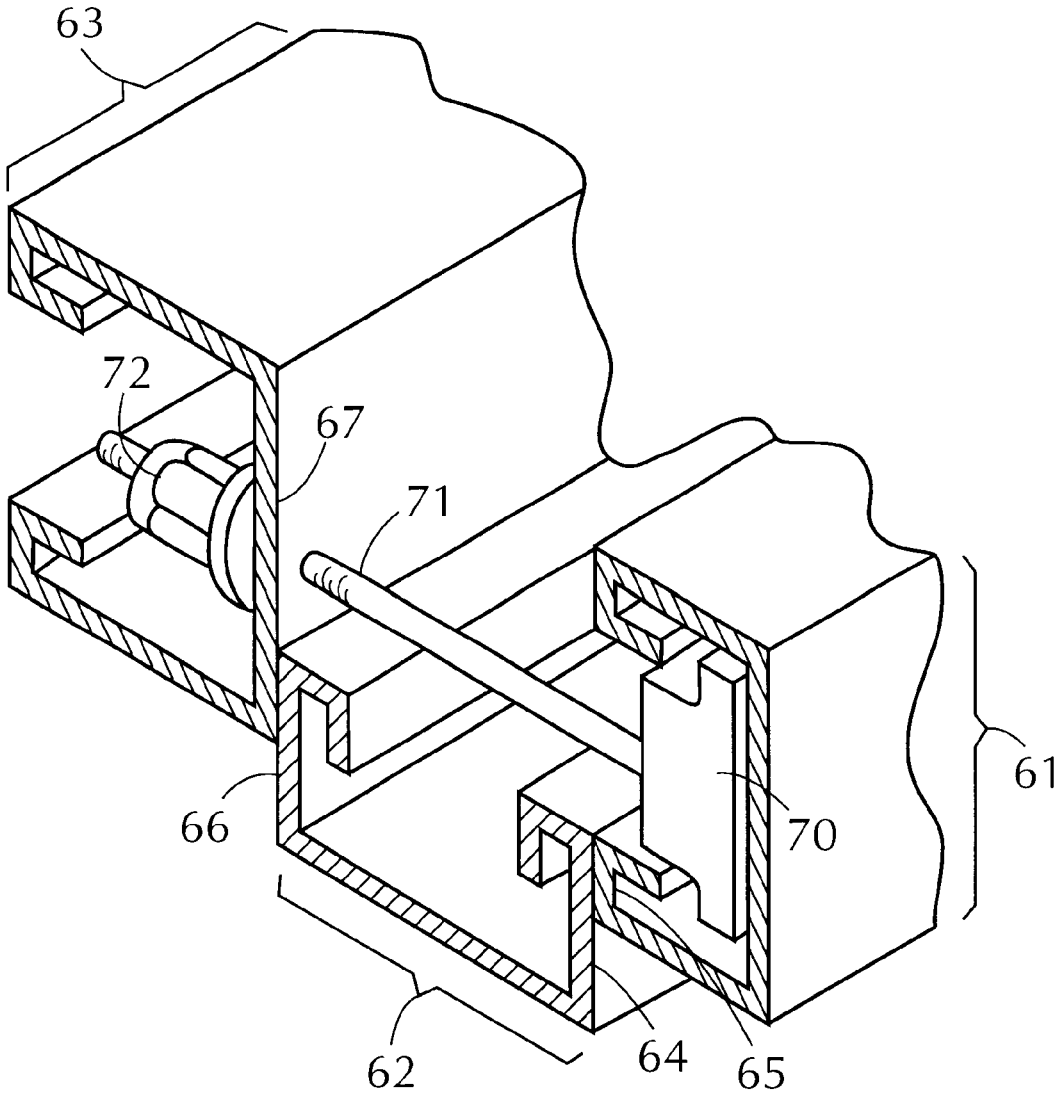
FIG. 5 is a front cutaway view of structural members arranged to form a support member of the present invention.

FIG. 5 is a close-up cutaway view of support member **(4(*a*)) that is depicted in the window frame of FIG. 1. FIG. 5 illustrates a configuration of structural members (61), (62) and (63) that is very similar to the configuration of structural members (5), (6) and (7) as depicted in FIG. 2**.

As such, FIG. 5 illustrates the configuration of structural members (61), (62) and (63) wherein the three structural members are in overlying relation to one another and are configured to form a support member **(4(*a*)). The outside surface of arm (64) of structural member (62) is in overlying relation with at least a portion of the outside surface of the end portion (65) of structural member (61). The outside surface of arm (66) of structural member (62) is in further overlying relation with at least a portion of the outside surface of the base portion (67) of structural member (63). FIG. 1 illustrates that gaskets (68) and (69) are disposed between the two structural members (61) and (63) and translucent barrier (37)**.

As seen in FIG. 5, support member **(4(*a*)) is firmly held together by fastener (70). Threaded rod (71) of fastener (70) is seen positioned in a hole drilled through the outside surface of base portion (67) of structural member (63) and into the defined U-shaped channel of structural member (63). The hole in which threaded rod (71) is positioned is located outwardly beyond the region in which translucent barrier (37) is disposed. Securing nut (72) to the distal end of threaded rod (71) detachably secures structural member (61) to structural member (63) with structural member (62) and translucent barrier (37) detachably secured therebetween. Gaskets (68) and (69) are disposed between the two structural members (61) and (63) and translucent barrier (37)**.

Although the present invention has been described with particularity, it will be apparent to those of ordinary skill in the art at the time the invention was made that various modifications may be made to the described invention without departing from the spirit or scope thereof. Accordingly, the scope of the present invention is intended to be defined by the appended claims.

I claim:

1. A window frame comprising:

a support member arranged to form a supporting structure, wherein said support member includes at least first, second and third structural members, wherein each of said structural members have substantially identically-shaped configurations, wherein each of said structural members have a substantially U-shaped channel defined by a base portion having a first arm and a second arm spaced apart on opposite lengthwise sides of said base portion, wherein said first and second arms extend from said base portion, and wherein said first and second arms have end portions, said end portions being turned inward and extending in a direction toward said base portion; and a plurality of fasteners adapted for detachably securing said structural members in a configuration adapted to detachably mount a translucent barrier within said supporting structure formed by said structural member such that said first arm of said first structural member is adjacent at least a portion of one of said first end portion and said second end portion of said second structural member, and said second arm of said first structural member is adjacent at least a portion of said base portion of said third structural member.

2. The window frame of claim 1, wherein said supporting structure is a closed pattern.

3. The window frame of claim 1, wherein said end portions of said first and second arms are in substantially parallel relationship to one another.

4. The window frame of claim 1, wherein said end portions of said first and second arms and said base portion are in substantially parallel relationship to one another.

5. The window frame of claim 1, wherein all of said structural members are metal.

6. The window frame of claim 5, wherein all of said structural members are substantially similarly-shaped metal extrusions.

7. The window frame of claim 6, wherein said metal is a steel alloy.

8. The window frame of claim 1, wherein said translucent barrier is formed of glass.

9. The window frame of claim 1, wherein said fasteners are adapted for nesting in said end portions of said first and second arms and for slidingly engaging therewith.

10. The window frame of claim 9, wherein each fastener is adapted to detachably secure a first structural member to a second structural member with a third structural member therebetween, whereby said translucent barrier is detachably mounted in the structure configured.

11. The window frame of claim 1, wherein a gasket is disposed between each of said structural members and said translucent barrier.

12. The window frame of claim 1, wherein said first arm and said second arm are substantially perpendicular to said base portion.

13. The window frame of claim 12, wherein said first arm and said second arm have substantially the same longitudinal length as said base portion.

* * * * *